US008826661B2

(12) United States Patent
Takahata

(10) Patent No.: US 8,826,661 B2
(45) Date of Patent: Sep. 9, 2014

(54) COOLING STRUCTURE OF SUPERCHARGER

(75) Inventor: Terumitsu Takahata, Osaka (JP)

(73) Assignee: Yanmar Co., Ltd., Osaka-shi, Osaka (JP)

( * ) Notice: Subject to any disclaimer, the term of this patent is extended or adjusted under 35 U.S.C. 154(b) by 553 days.

(21) Appl. No.: 13/061,444

(22) PCT Filed: Mar. 25, 2009

(86) PCT No.: PCT/JP2009/055894

§ 371 (c)(1),
(2), (4) Date: Feb. 28, 2011

(87) PCT Pub. No.: WO2010/023984

PCT Pub. Date: Mar. 4, 2010

(65) Prior Publication Data

US 2011/0154818 A1 Jun. 30, 2011

(30) Foreign Application Priority Data

Sep. 1, 2008 (JP) ..... 2008-224144

(51) Int. Cl.

| | |
|---|---|
| ***F02B 33/44*** | (2006.01) |
| ***F02B 33/00*** | (2006.01) |
| ***F04B 17/00*** | (2006.01) |
| ***F04D 29/049*** | (2006.01) |
| ***F01D 25/26*** | (2006.01) |
| ***F01D 25/14*** | (2006.01) |
| ***F01P 3/20*** | (2006.01) |
| ***F02B 39/00*** | (2006.01) |
| *F02B 37/00* | (2006.01) |

(52) U.S. Cl.

CPC ..... *F02B 39/005* (2013.01); *F01P 2060/02* (2013.01); *F02B 37/00* (2013.01); *F04D 29/049* (2013.01); *F01P 2060/12* (2013.01); *F01D 25/26* (2013.01); *F01D 25/145* (2013.01); *F01P 2050/06* (2013.01); *F05D 2220/40* (2013.01); *F01P 3/207* (2013.01); *F01P 2060/045* (2013.01)

USPC ..... 60/605.3; 60/599; 123/563; 417/406

(58) Field of Classification Search

USPC ..... 123/563; 60/602, 605.3, 599; 415/118, 415/200, 206; 417/406

See application file for complete search history.

(56) References Cited

U.S. PATENT DOCUMENTS

| | | | | |
|---|---|---|---|---|
| 2,866,617 | A * | 12/1958 | Land | 417/406 |
| 5,528,902 | A | 6/1996 | Hoerl et al. | |
| D611,064 | S * | 3/2010 | Takahata | D15/5 |
| 8,356,581 | B2 * | 1/2013 | Fletcher | 123/41.31 |
| 2006/0083609 | A1 * | 4/2006 | Augspurger | 415/206 |
| 2007/0214789 | A1 | 9/2007 | Stiermann | |
| 2011/0008158 | A1 * | 1/2011 | Boening et al. | 415/200 |

FOREIGN PATENT DOCUMENTS

| | | | | |
|---|---|---|---|---|
| DE | 34 39 738 | A1 | 4/1986 | |
| DE | 103 36 978 | B3 | 1/2005 | |
| DE | 102008011258 | * | 9/2009 | F01D 25/14 |
| EP | 1 835 164 | A2 | 9/2007 | |
| JP | H2-13142 | | 1/1990 | |
| JP | H3-56835 | | 5/1991 | |
| JP | H4-76932 | | 7/1992 | |
| JP | H6-73337 | | 10/1994 | |
| JP | 2000-074526 | | 3/2000 | |

OTHER PUBLICATIONS

International Search Report for International Application No. PCT/JP2009/055894, Japanese Patent Office, mailed Jun. 9, 2009, 4 pgs.
European Search Report for EP 09809639.3 (International Application No. PCT/JP2009/055894), mailed Apr. 10, 2014, 5 pages.
Patent Abstract of DE 3439738 A1, dated Apr. 30, 1986, 1 page.
Patent Abstract of DE 10336978 B3, dated Jan. 13, 2005, 1 page.

* cited by examiner

*Primary Examiner* — Thai Ba Trieu
*Assistant Examiner* — Thomas Olszewski

(74) *Attorney, Agent, or Firm* — Sterne, Kessler, Goldstein & Fox P.L.L.C.

(57) ABSTRACT

In order to reduce radiation heat from the turbine housing of a supercharger, the turbine housing is conventionally water-cooled or covered with a heat shielding material, but it is required to control heat loss due to excessive water cooling or high temperature on the outer surface of the heat shielding material. On the contrary, a solution by a cooling structure consisting of an inner thermal insulation portion of an air layer and an outer low temperature portion covering the inner thermal insulation portion has an inevitable problem of increasing number of components and upsizing. In a cooling structure of a supercharger (2) equipped with a turbine wheel (35) which rotates with exhaust gas from an engine (1) and provided, on the periphery of a turbine housing (40) for housing the turbine wheel (35), with a cooling structure (47) consisting of an inner thermal insulation portion of an air layer (45) and an outer low temperature portion covering the inner thermal insulation portion, the outer low temperature portion is constituted by integrally forming a circulation passage (46) of fresh water in a turbine cover (39) which covers and protects the turbine housing (40).

7 Claims, 12 Drawing Sheets

COOLING STRUCTURE OF SUPERCHARGER

TECHNICAL FIELD

The present invention relates to a supercharger having a turbine wheel rotated by exhaust gas from an engine, especially a cooling structure of a supercharger in which a cooling structure body, which reduces certainly radiation heat to the circumference of the supercharger while preventing reduction of turbine efficiency caused by excessive cooling of a turbine housing in which the turbine wheel is housed, can be arranged in small space with few parts.

BACKGROUND ART

Generally, a supercharger is known in which a turbine wheel is rotated by exhaust gas from an engine so as to rotate an impeller via a turbine shaft constructed integrally with the turbine wheel, whereby sucked air (hereinafter, referred to as "intake air") is compressed and sent to cylinders of a cylinder head. In the supercharger, temperature of a turbine housing in which the turbine wheel is housed is made very high by the heat of exhaust gas, therefore it is necessary to protect the other components of the engine and peripherals around the supercharger from radiation heat of the turbine housing. Especially, in an engine for a ship, for preventing ignition of combustible parts and oil by radiation heat so as to prevent certainly the fire in the ship, an art is required for reducing the radiation heat from the turbine housing.

Then, conventionally, an art is known in which a cooling jacket is formed in the turbine housing and coolant such as fresh water with low temperature is circulated in the cooling jacket so as to cool compulsorily the turbine housing, thereby reducing the radiation heat from the turbine housing to the circumference of the supercharger (for example, see the Patent Literature 1). An art is also known in which the turbine housing is covered by heat insulating material such as asbestos, lagging material in which the heat insulating material is confined, or a heat shield body such as a masking shield formed by enclosing the heat insulating material between metal plates, thereby reducing the radiation heat from the turbine housing to the circumference of the supercharger (for example, see the Patent Literature 2).

However, in the former art, though the heat of the turbine housing is absorbed by the coolant flowing in the cooling jacket and the temperature of the turbine housing is reduced so as to reduce the radiation heat from the turbine housing is reduced, heat loss of the exhaust gas with high temperature and high pressure flowing in a turbine chamber inside the turbine housing is increased so as to reduce the turbine efficiency, and the temperature of the coolant absorbing much heat is raised so that cooling efficiency in the case of cooling the engine or the like with the coolant is reduced. In the latter art, in the case that the supercharger is driven for long time, heat is accumulated by transmission and radiation of heat from the turbine housing so that the temperature of the turbine housing is raised remarkably and heat transmission from the turbine housing to the outside cannot be suppressed enough, whereby the outer surface of the heat shield body is heated and the radiation heat to the circumference of the supercharger is increased remarkably.

For suppressing the heat loss of the exhaust gas, the rise of temperature of the coolant, accumulation of heat and the like, it is conceivable to provide a cooling structure including an inner heat insulating part constructed by an air layer and an outer low temperature part covering, the inner heat insulating part around the turbine housing. According to the cooling structure, by interposing the inner heat insulating part, the turbine housing is prevented from touching directly the outer low temperature part, whereby the raise of temperature of the coolant in the outer low temperature part is reduced suitably while preventing excessive absorption of heat from the exhaust gas in the turbine chamber. Furthermore, the outer low temperature part absorbs efficiently heat transmitted from the turbine housing, thereby preventing accumulation of heat.

Patent Literature 1: the Japanese Utility Model Laid Open Gazette Hei. 4-76932

Patent Literature 2: the Japanese Utility Model Laid Open Gazette Hei. 6-73337

DISCLOSURE OF INVENTION

Problems to Be Solved by the Invention

However, the cooling structure as mentioned above has two-layer structure including the inner heat insulating part and the outer low temperature part, whereby the part number is increased and assemble ability and maintainability are reduced.

Furthermore, when the outer low temperature part is constructed by providing cooling piping or the like, arrangement space required for the outer low temperature part is remarkably enlarged, whereby the cooling structure is enlarged.

Means for Solving the Problems

The above-mentioned problems are solved by the following means of the present invention.

According to claim 1, in a cooling structure of a supercharger having a turbine wheel rotated by exhaust gas from an engine, the cooling structure is constructed by an inner heat insulating part constructed by an air layer and an outer low temperature part surrounding the inner heat insulating part and is provided around a turbine housing in which the turbine wheel is housed. The outer low temperature part is constructed by forming a circulation passage of coolant integrally inside a cover member which covers and protects the turbine housing.

According to claim 2, a coolant port feeding and discharging the coolant to the circulation passage and an exhaust inlet introducing exhaust gas from the engine to the turbine housing are arranged in parallel on the same side of the cover member along a side surface of the cover member.

According to claim 3, the circulation passage is provided along a rotational outer peripheral surface of the turbine wheel.

According to claim 4, the coolant is cooling water for cooling the engine.

Effect of the Invention

The present invention constructed as the above brings the following effects.

According to claim 1, in a cooling structure of a supercharger having a turbine wheel rotated by exhaust gas from an engine, the cooling structure is constructed by an inner heat insulating part constructed by an air layer and an outer low temperature part surrounding the inner heat insulating part and is provided around a turbine housing in which the turbine wheel is housed. The outer low temperature part is constructed by forming a circulation passage of coolant integrally inside a cover member which covers and protects the turbine housing. Accordingly, the outer low temperature part of the cooling structure can be provided by employing the cover member, whereby the part number of the cooling structure can be reduced so as to reduce part cost and improve assemble ability and maintainability. Furthermore, it is not necessary to provide any cooling piping or the like on the outer surface of the cover member, whereby the establishment space required for the outer low temperature part can be reduced and the cooling structure can be made compact. In this cooling structure, the turbine housing can be made not touch directly the outer low temperature part, whereby heat of exhaust gas in the turbine chamber of the turbine housing is prevented from being absorbed excessively so as to prevent the reduction of turbine efficiency. Moreover, when coolant such as fresh water with low temperature is employed in the outer low temperature part, the rise of temperature of the coolant is reduced suitably by the inner heat insulating part, whereby the reduction of cooling efficiency of the engine and the like in which the coolant is employed can be prevented. In addition, the heat transmitted from the turbine housing by heat conduction and convection following the drive of the supercharger for long time is absorbed effectively by the outer low temperature part, and radiation from the turbine housing is blocked certainly by the outer low temperature part. Accordingly, the heat is discharged and the temperature of the outer surface of the outer low temperature part, that is, the outer surface of the cooling structure does not become so high, whereby radiation heat to the circumference of the supercharger can be reduced certainly.

According to claim 2, a coolant port feeding and discharging the coolant to the circulation passage and an exhaust inlet introducing exhaust gas from the engine to the turbine housing are arranged in parallel on the same side of the cover member along a side surface of the cover member. Accordingly, the coolant port and the exhaust inlet are arranged intensively in the vicinity of the attachment position of the exhaust turbine so as to reduce connection space required for feed/discharge of the coolant and introduction of the exhaust gas, whereby the exhaust turbine, in its turn the supercharger can be made compact.

According to claim 3, the circulation passage is provided along a rotational outer peripheral surface of the turbine wheel. Accordingly, the circulation passage of the coolant can be disposed along the part of the turbine housing with especially high temperature, whereby the cooling efficiency of the outer low temperature part can be improved.

According to claim 4, the coolant is cooling water for cooling the engine. Accordingly, a conventional water cooling system for cooking an engine can be employed without providing separately coolant and any pump and tank for supplying the coolant to the circulation passage, whereby the parts required for cooling the supercharger can be reduced so as to further reduce the cost of parts, improve the maintainability and make the engine compact.

DESCRIPTION OF NOTATIONS

Figure 1:
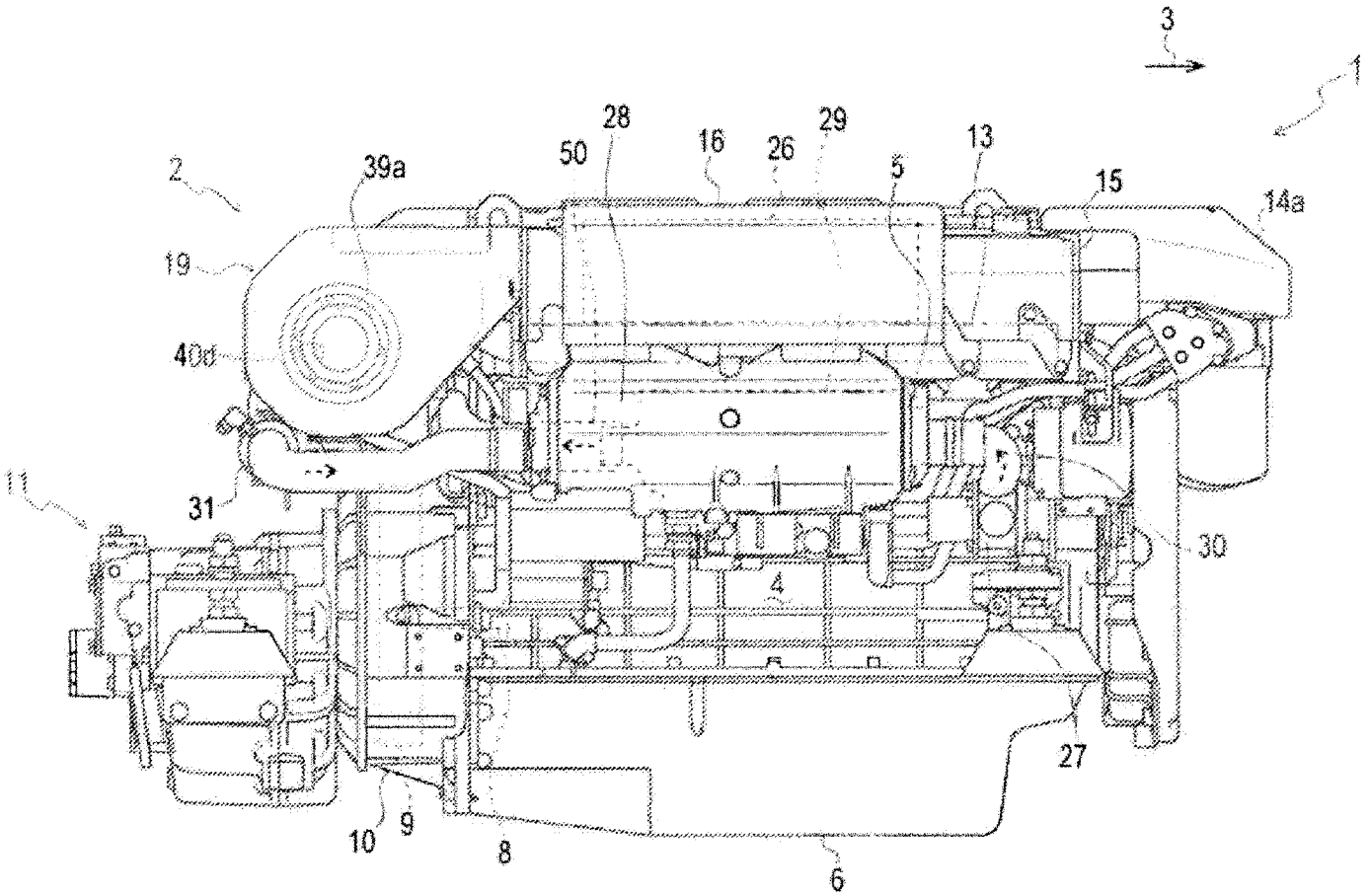
FIG. 1 It is a right side view of entire construction of an engine according to the present invention.
Figure 2:
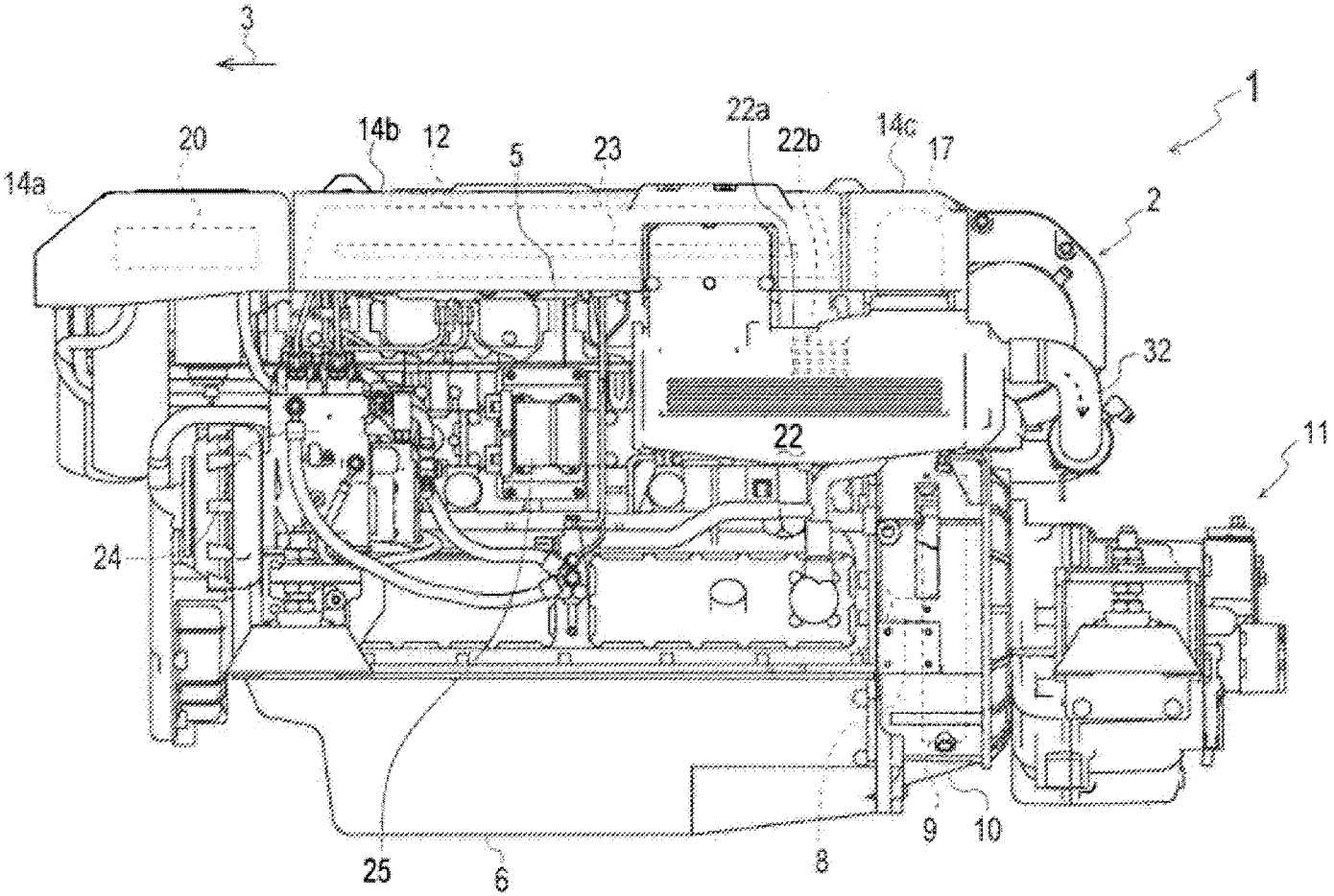
FIG. 2 It is a left side view of the engine.

1 engine
2 supercharger
35 turbine wheel
39 turbine cover (outer low temperature part, cover member)
39*b* inner peripheral surface
39*f* and 39*g* pure water inlet and outlet (coolant port)
39*h* front side surface (side surface)
40 turbine housing
40*e* outer peripheral surface
41*c* exhaust inlet
45 air layer (inner heat insulating part)
46 circulation passage
47 cooling structure

THE BEST MODE FOR CARRYING OUT THE INVENTION

Next, explanation will be given on the mode for carrying out the invention.

In below explanation, direction of a crankshaft of an engine 1 is regarded as the longitudinal direction, the output side of the engine 1 (at a side of a clutch 11 discussed later) is regarded as the rear, and the side opposite thereto (direction of an arrow 3 in FIG. 3) is regarded as the front. Furthermore, the direction perpendicular to the direction of the crankshaft of the engine 1 is regarded as the lateral direction, the right side when viewed from the rear (direction of an arrow 21 in FIG. 3) is regarded as the right, and the side opposite thereto is regarded as the left.

Firstly, explanation will be given on the entire construction of the engine 1 having a supercharger 2 according to the present invention referring to FIGS. 1 to 4.

The engine 1 has a cylinder block 4 which is extended longitudinally. A cylinder head 5 is provided at the upper end of the cylinder block 4, and an oil pan 6 is provided at the lower end of the cylinder block 4. Each of the oil pan 6 and the cylinder head 5 is extended longitudinally along the cylinder block 4. The upper surface of the cylinder head 5 is covered by two rocker arm chamber casings 7 fixed thereto, and a rocker arm chamber (not shown) in which a rocker arm, a fuel injection valve and the like is formed in each of the rocker arm chamber casings 7.

In the cylinder block 4, a crankshaft 8 is provided substantially horizontally so as to extend longitudinally. A flywheel 9 is attached to the rear end of the crankshaft 8, and the flywheel 9 is covered by a flywheel housing 10 fixed to the rear end of the cylinder block 4. Furthermore, the clutch 11 is interlockingly connected to the rear end surface of the flywheel housing 10 so that the clutch 11 can transmit/isolate the engine output from the crankshaft 8.

An exhaust manifold 13 is provided on the right side surface of the cylinder head 5 along the right side surface over the length substantially the same as the cylinder head 5. A container box 26 for various kinds of relays, fuses and the like is provided outside the right side of the exhaust manifold 13. The exhaust manifold 13 and the container box 26 are respectively covered by a cover 15 and a cover 16. Below the exhaust manifold 13, a seawater pump 27 drawing up seawater as cooling water and a fresh water cooler 28 exchanging the heat between cooling fresh water supplied to a cooling jacket of the main body of the engine 1 and the seawater so as to cool the fresh water are disposed in this order from the front side. At the side of the fresh water cooler 28 inside the engine body, an oil cooler 29 cooling lubricating oil of the engine 1 is disposed.

Behind the exhaust manifold 13, the supercharger 2 according to the present invention is provided. As discussed later, a part of the fresh water from the fresh water cooler 28 is supplied to the supercharger 2, and the fresh water cools a turbine cover 39 of the supercharger 2.

On the left side surface of the cylinder head 5, similarly to the exhaust manifold 13, an intake manifold 12 is provided along the left side surface over the length substantially the same as the cylinder head 5. Furthermore, behind the intake manifold 12, a left end of an intake passage 17 extended laterally behind the rocker arm chamber casings 7 is arranged. The right end of the intake passage 17 is communicated with a compressor 18 of the supercharger 2, and the intake manifold 12 and the intake passage 17 are respectively covered by a top cover 14*b* and a top cover 14*c*. Moreover, just below the part from the rear portion of the intake manifold 12 to the left end of the intake passage 17, an intercooler 22 cooling intake air from the supercharger 2 by heat exchange with seawater is formed extendingly longitudinally.

A common rail 23 is provided in the top cover 14*b*. The fuel discharge side of the common rail 23 is connected to an injector (not shown) injecting fuel into a combustion chamber, and the fuel supply side of the common rail 23 is connected to a high-pressure fuel pump 24 disposed in the front portion of the right side surface of the cylinder block 4. Furthermore, a top cover 14*a* covering the upper surface of the front end of the engine 1 over the lateral width of the upper surface is disposed before the top cover 14*b*. An engine control unit 20 generally controlling the fuel injection system of the engine 1 is housed in the top cover 14*a*. An injector driver unit 25 is disposed at substantially the center of the left side surface of the engine 1.

In this construction, high-pressure fuel obtained by pressurization with the high-pressure fuel pump 24 is divided through the common rail 23 to each injector, and fuel injection amount, injection timing and the like of each injector are suitably controlled by the engine control unit 20 and the injector driver unit 25. Accordingly, the common rail-type electronic control fuel injection system with small fuel consumption and high combustibility is formed in the engine 1.

Next, explanation will be given on cooling construction of the engine 1 as mentioned above referring to FIGS. 1 to 4.

Cooling seawater for heat exchange is drawn up by the seawater pump 27 through a seawater inlet port (not shown). The drawn seawater passes through a cooling water pipe 30 connecting the seawater pump 27 to the oil cooler 29 and flows into the oil cooler 29 so as to cool lubricating oil. The seawater after cooling passes from a rubber hose 50 connecting the rear end of the oil cooler 29 to the rear end of the intercooler 22 through a cooling water pipe 51 and flows into the intercooler 22.

The intercooler 22 has a substantially cylindrical cooler casing 22*a* constructing the external form of the intercooler 22 and a large number of cooling pipes 22*b* disposed in the cooler casing 22*a* in parallel to each other. The water supply end of each of the cooling pipes 22*b* is connected to the end of the cooling water pipe 51, and the water discharge end of each of the cooling pipes 22*b* is connected to an end of a cooling water pipe 32. Accordingly, the seawater from the oil cooler 29 passes through the cooling pipes 22*b* in the cooler casing 22*a* and cools the space around the cooling pipes 22*b*, and then is discharged through the cooling water pipe 32.

On the other hand, the upper end of the rear portion of the cooler casing 22*a* is connected to the left end of the intake passage 17 communicated with the compressor 18 of the supercharger 2, and the upper end of the front portion of the cooler casing 22*a* is connected to the lower end of the real portion of the intake manifold 12. Accordingly, intake air with high temperature which is compressed by the compressor 18 of the supercharger 2 so that the temperature thereof is raised passes through the intake passage 17 and flows into the cooler casing 22*a*, and is cooled while flowing in the space around the cooling pipes 22*b*. The cooled intake air is divided through the intake manifold 12 to the cylinders of the cylinder head 5.

The cooling water pipe 32 is connected through an oil cooler 49 for cooling lubricating oil of the clutch 11 to a cooling water pipe 31, and the fresh water cooler 28 is connected to the front end of the cooling water pipe 31. Accordingly, the seawater from the intercooler 22 passes through the cooling water pipe 32, flows into the oil cooler 49, cools the lubricating oil of the clutch 11 in the oil cooler 49, and then passes through the cooling water pipe 31 and flows into the fresh water cooler 28. In the fresh water cooler 28, fresh water circulating in a fresh water circulation system is cooled by heat exchange with seawater with low temperature, and the cooled fresh water is supplied to the cooling jacket of the engine 1 and an exhaust turbine 19 of the supercharger 2 according to the present invention.

Next, explanation will be given on the construction of the supercharger 2 according to the present invention and the cooling construction thereof referring to FIGS. 1 to 12.

As shown in FIGS. 1 to 4, the supercharger 2 includes the compressor 18 and the exhaust turbine 19 and these members are provided in series laterally behind the exhaust manifold 13. An impeller 33 which is a vane wheel of the compressor 18 and a turbine wheel 35 which is a vane wheel of the exhaust turbine 19 are connected to each other via a turbine shaft 34 rotatably supported by a bearing (not shown).

In the exhaust turbine 19, the turbine wheel 35 is housed in a turbine housing 40. A rear end of a connection pipe 41 is connected to the front portion of the turbine housing 40, and the front end of the connection pipe 41 is connected to the rear end of the exhaust manifold 13. Furthermore, the turbine housing 40 is covered by the turbine cover 39 according to the present invention, and a circular exhaust port 39*a* is opened in the right side surface of the turbine cover 39 so as to overlap an opening 40*d* in the right side surface of the turbine housing 40.

In the compressor 18, an air cleaner 37 and an impeller housing 38 are provided in series laterally in this order rightward behind the top cover 14*c*, and the impeller 33 is housed in the impeller housing 38. The front end of the impeller housing 38 is communicated with the right end of the intake passage 17.

In this construction, exhaust gas introduced from the exhaust manifold 13 through the connection pipe 41 into the turbine housing 40 rotates the turbine wheel 35, and then passes through the opening 40*d* of the turbine housing 40 and is discharged through the exhaust port 39*a* of the turbine cover 39. Following it, the impeller 33 is rotated integrally with the turbine wheel 35 through the turbine shaft 34 so as to introduce intake air from the outside. The introduced intake air is cleaned by the air cleaner 37 and then flows into the impeller housing 38, and the flowing intake air is compressed by the impeller 33 and then sent to the intake passage 17.

Then, as mentioned above, the intake air with high temperature heated by the compression passes through the intake passage 17 and flows into the cooler casing 22*a*, and is cooled while flowing in the space around the cooling pipes 22*b*. The cooled intake air is divided through the intake manifold 12 to the cylinders of the cylinder head 5 as compressed air, thereby improving engine output and fuel economy.

Figure 3:
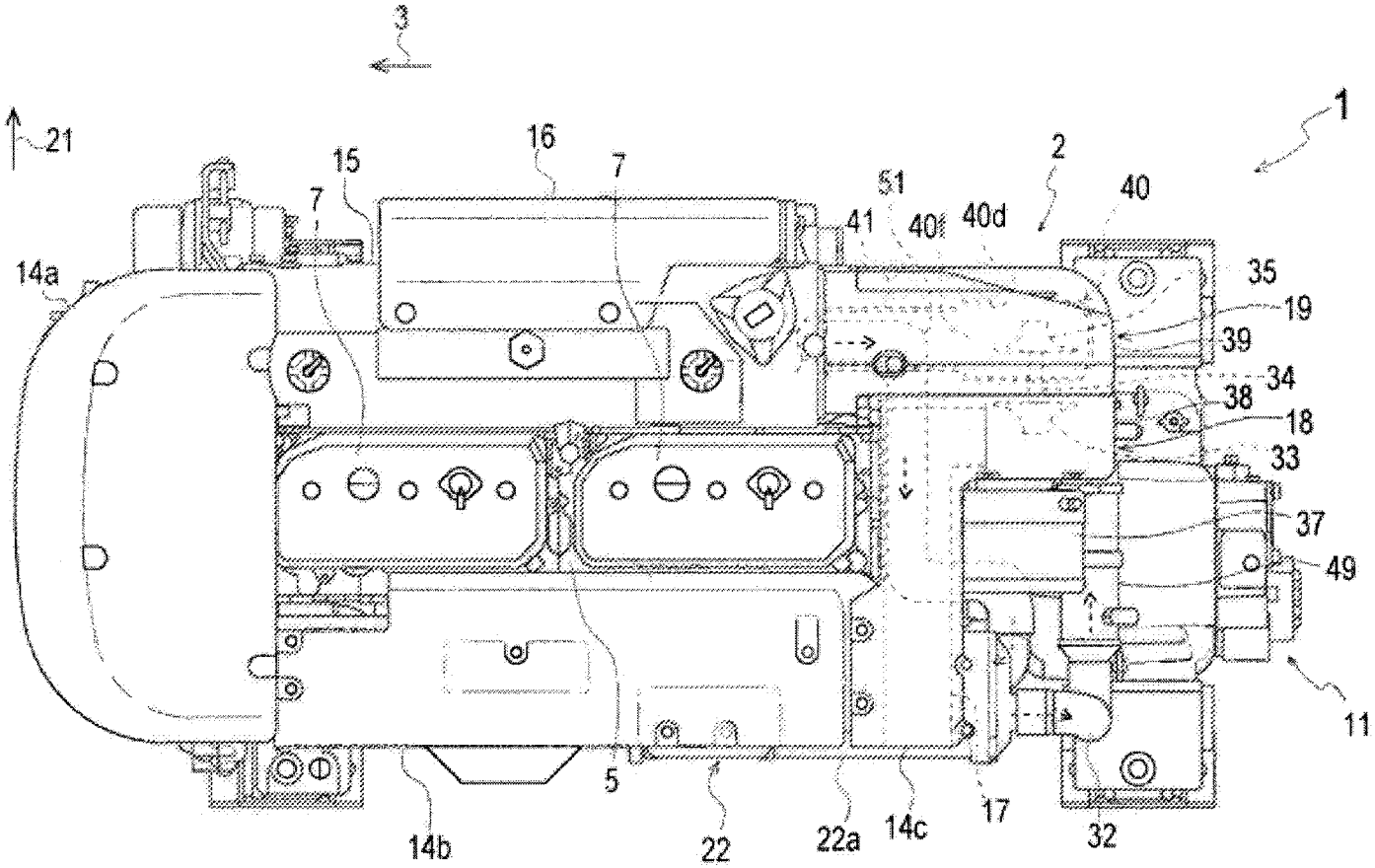
FIG. 3 It is a plan view of the engine.
Figure 4:
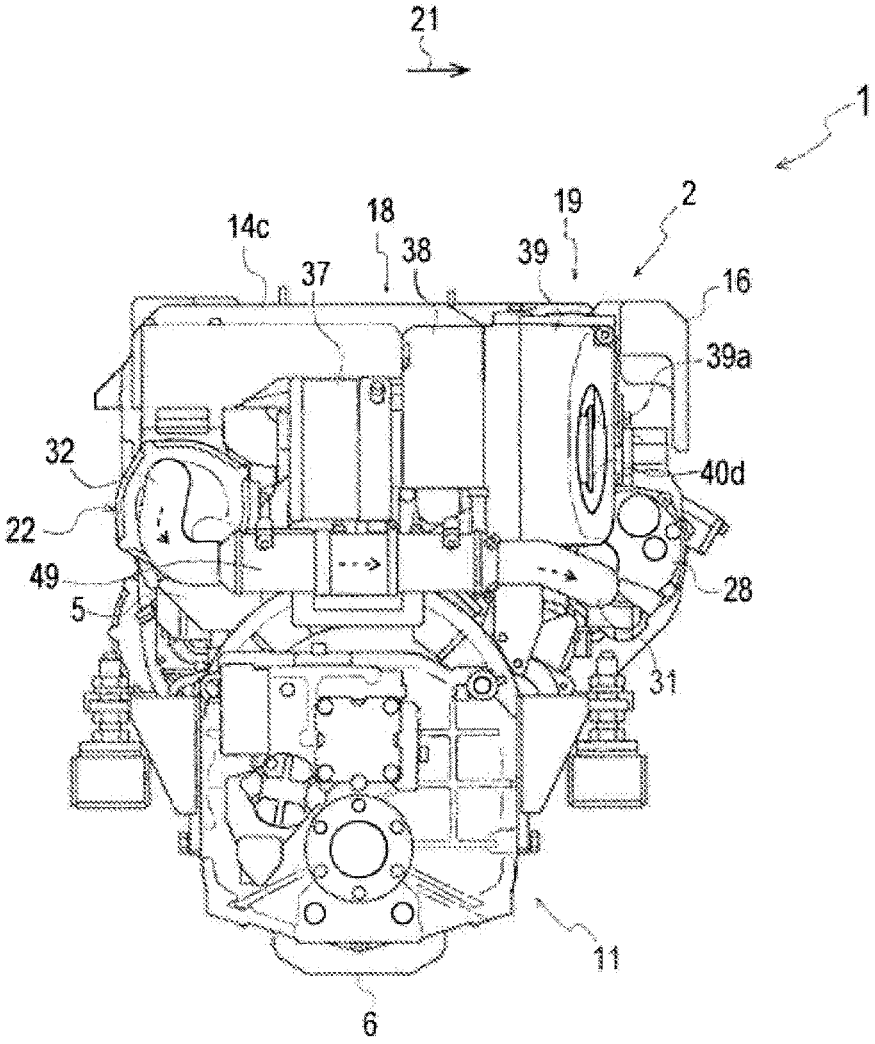
FIG. 4 It is a rear view of the engine.
Figure 5:
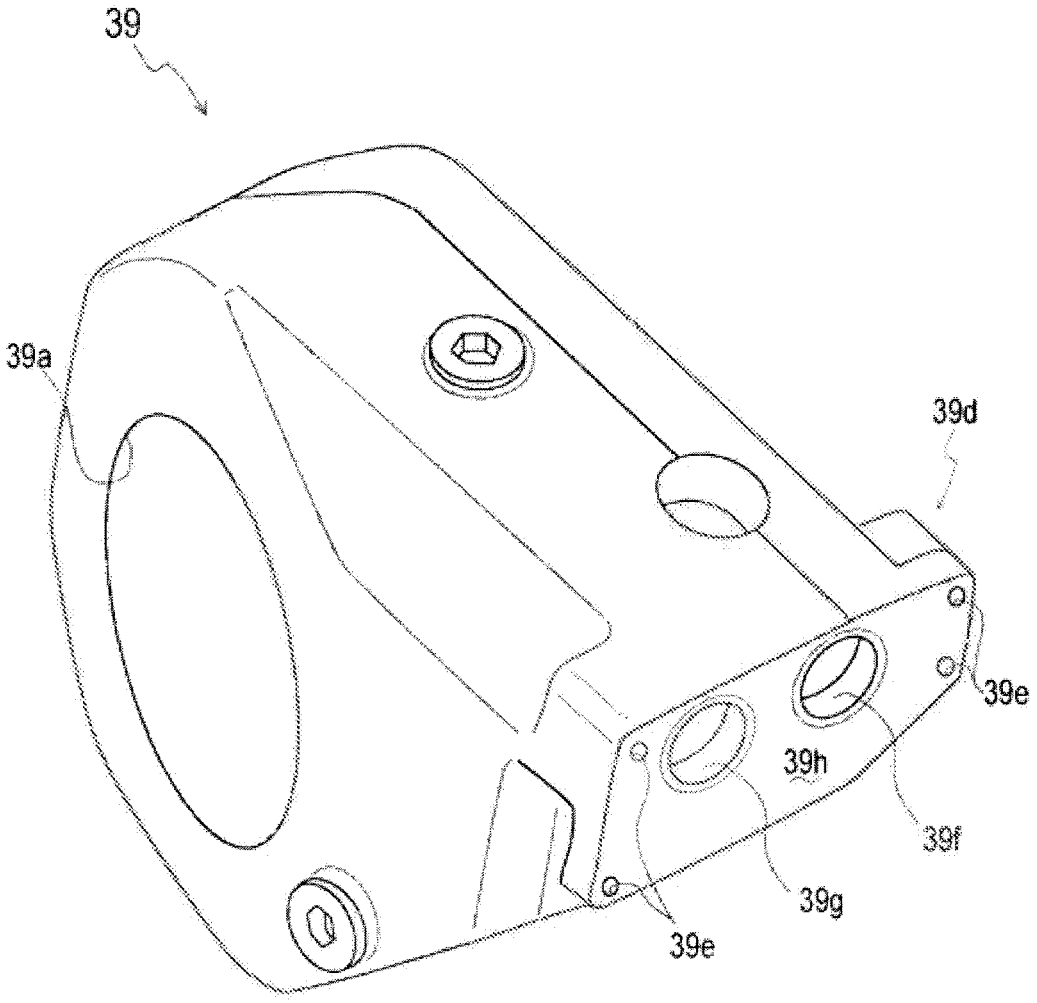
FIG. 5 It is a perspective front view of a turbine cover.
Figure 8:
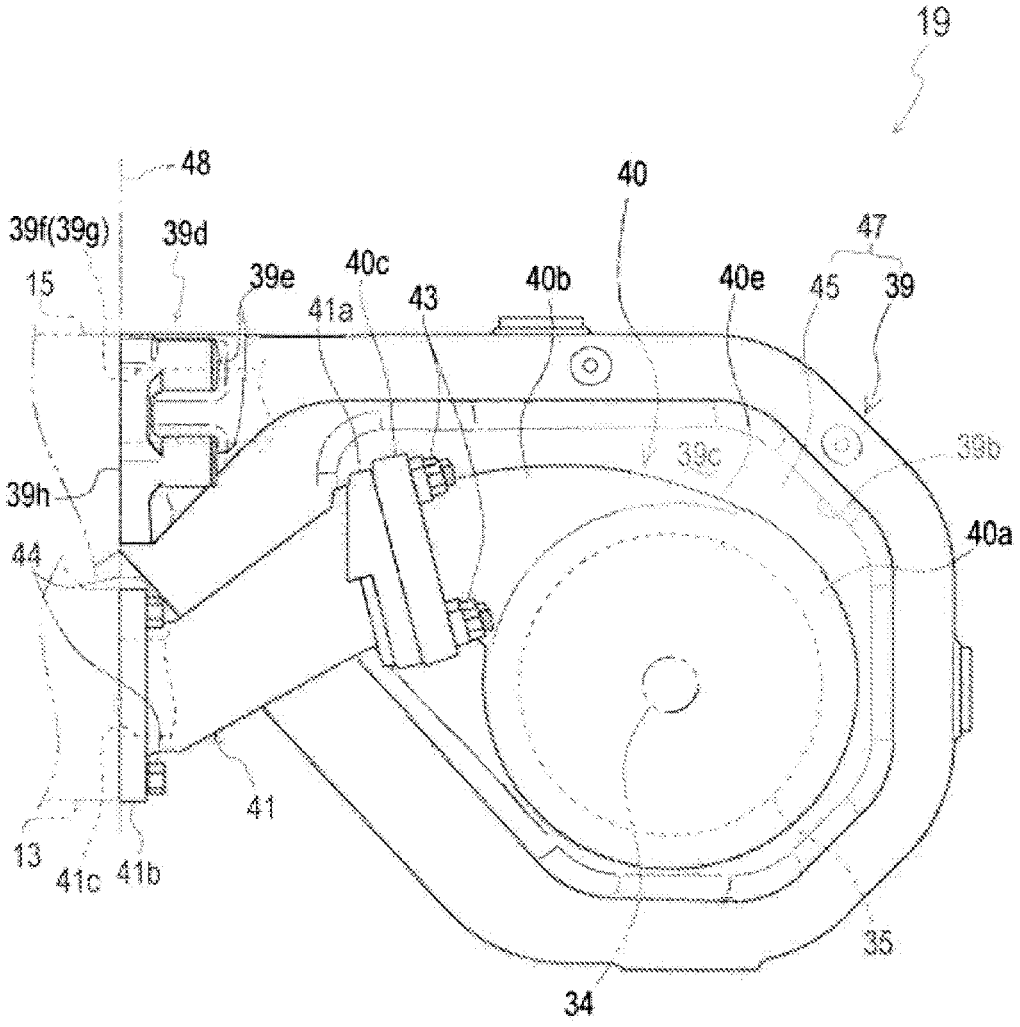
FIG. 8 It is a left side view of an exhaust turbine.
Figure 9:
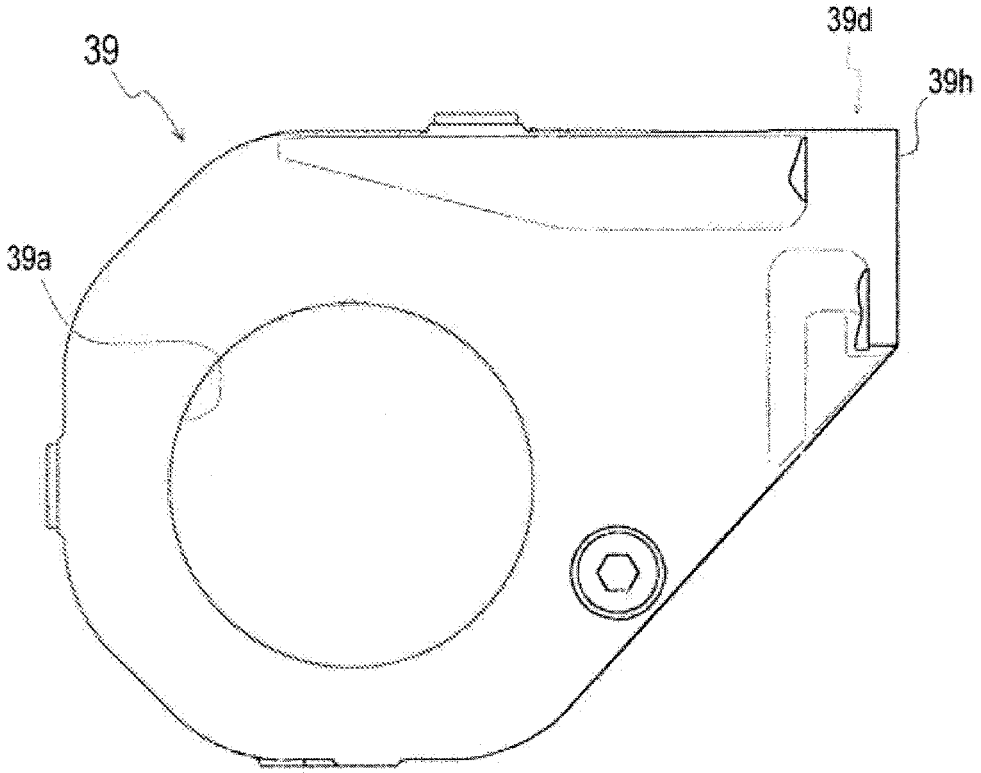
FIG. 9 It is a right side view of the turbine cover.
Figure 10:
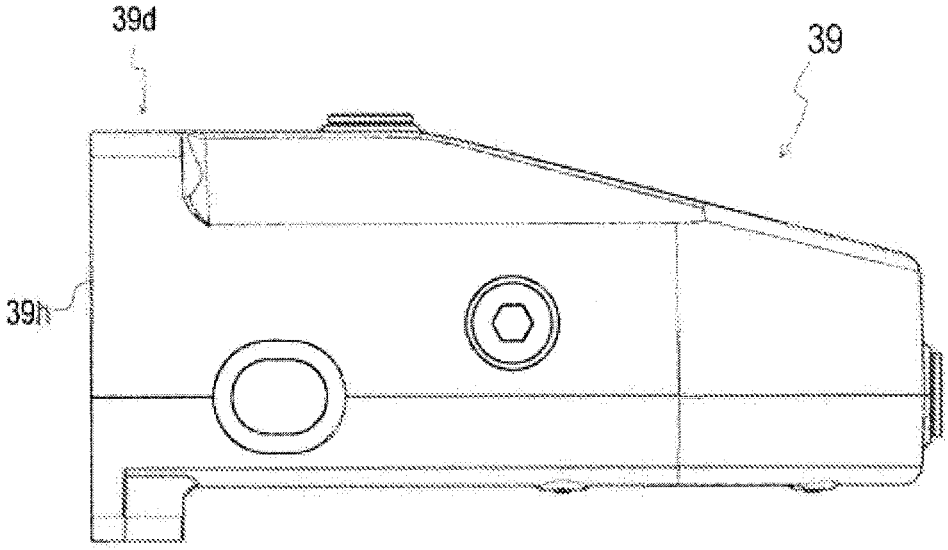
FIG. 10 It is a plan view of the turbine cover.
Figure 11:
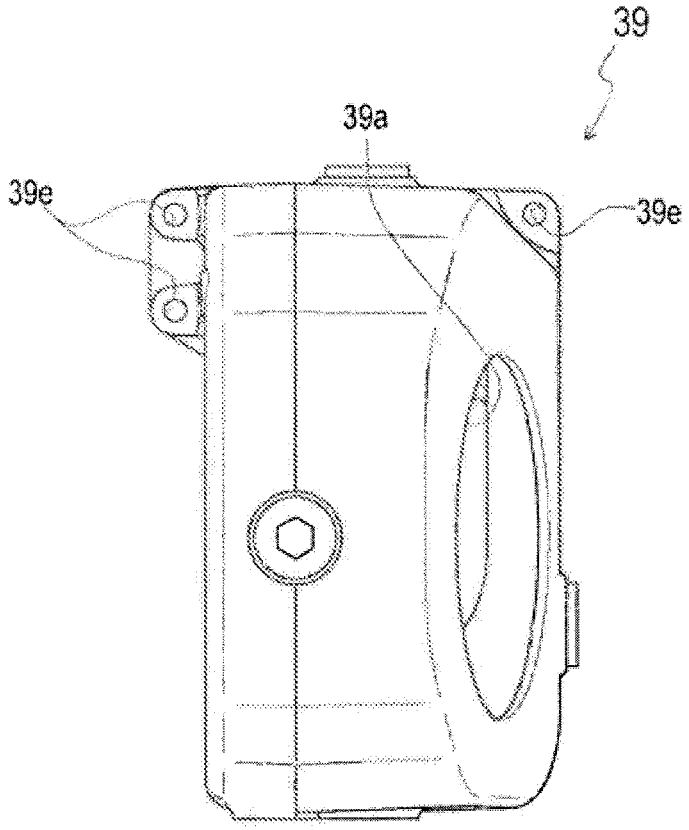
FIG. 11 It is a rear view of the turbine cover.
Figure 12:
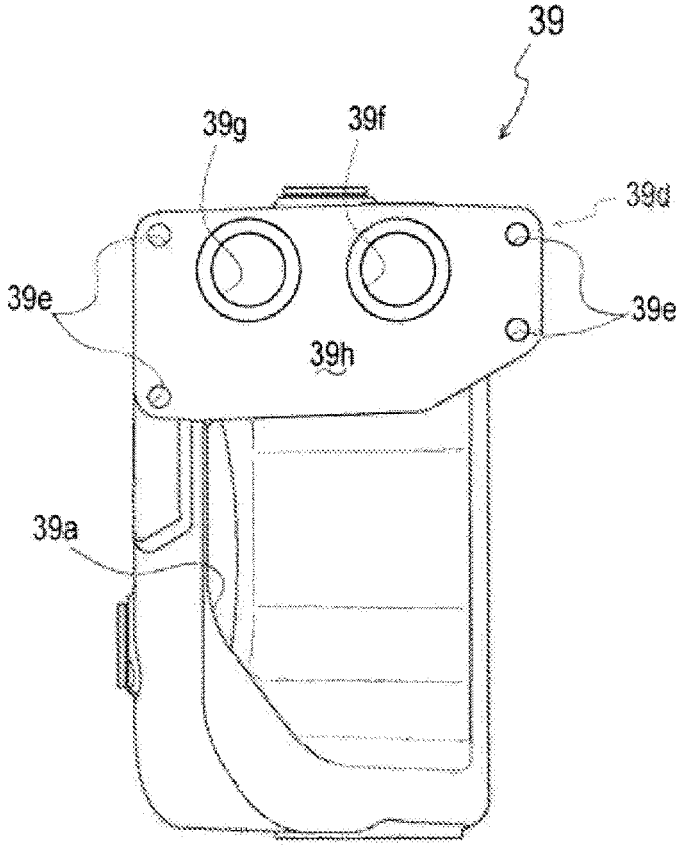
FIG. 12 It is a front view of the turbine cover.

As shown in FIGS. 3 and 8, the turbine housing 40 includes a cylinder part 40*a* having a lateral horizontal axis and an exhaust introduction part 40*b* projectingly provided circular cone-like forward from an upper front portion of an outer peripheral surface 40*e* of the cylinder part 40*a*, and the cylinder part 40*a* and the exhaust introduction part 40*b* are constructed integrally. A flange 40*c* is formed in the front end opening of the exhaust introduction part 40*b*, and the flange 40*c* is fastened and fixed to a rear flange 41*a* at the rear end of the connection pipe 41 by a plurality of fasteners 43 such as bolts, whereby the turbine housing 40 is connected to the connection pipe 41.

Furthermore, a front flange 41*b* in which an exhaust inlet 41*c* is opened is formed at the front end of the connection pipe 41, and the front flange 41*b* is fastened and fixed to the rear end of the exhaust manifold 13 by a plurality of fasteners 44, whereby the connection pipe 41 is connected to the exhaust manifold 13.

The turbine housing 40 connected to the exhaust manifold 13 as mentioned above is held inside a cover chamber 39*c* of the turbine cover 39 while the outer peripheral surface 40*e* of the turbine housing 40 is prevented from touching directly an inner peripheral surface 39*b* of the turbine cover 39. A gap of predetermined thickness is secured between the outer peripheral surface 40*e* and the inner peripheral surface 39*b*, and the gap is filled up with an air layer 45.

The air layer 45 functions as material with high resistance against heat conduction, i.e. so-called heat insulating material, whereby the heat of the turbine housing 40 is transmitted to the turbine cover 39 only by radiation and convection mainly. Therefore, in the exhaust gas flowing inside a turbine chamber 40*f* of the turbine housing 40, heat not emitted by the heat conduction is accumulated, whereby remarkable deterioration of the temperature of the exhaust gas is suppressed. Simultaneously, heat input to the turbine cover 39 cooled by fresh water is also reduced as discussed later, whereby the temperature rise of the fresh water after the cooling of the turbine housing 40 is suppressed.

The heat insulating capacity of the air layer 45 can be set to predetermined capacity by changing the thickness of the gap between the outer peripheral surface 40*e* and the inner peripheral surface 39*b* so as to change the thickness of the air layer 45, whereby the heat insulating capacity suitable for the supercharger 2 to be employed can be secured easily.

As shown in FIGS. 3 and 5 to 12, in the turbine cover 39, the circular exhaust port 39*a* is opened in the right side surface, and the left side surface is opened so as to cover the right side surface of the impeller housing 38. The lateral width of the front end of the turbine cover 39 is expanded so as to form an attachment part 39*d* and a pair of fastening holes 39*e* is bored in line vertically in each of the left and right projecting portions of the attachment part 39*d*. A plurality of bolts or the like (not shown) is screwed into the plurality of the fastening holes 39*e*, whereby the attachment part 39*d* is fastened and fixed to the rear end of the cover 15 in which the exhaust manifold 13 is housed.

Figure 6:
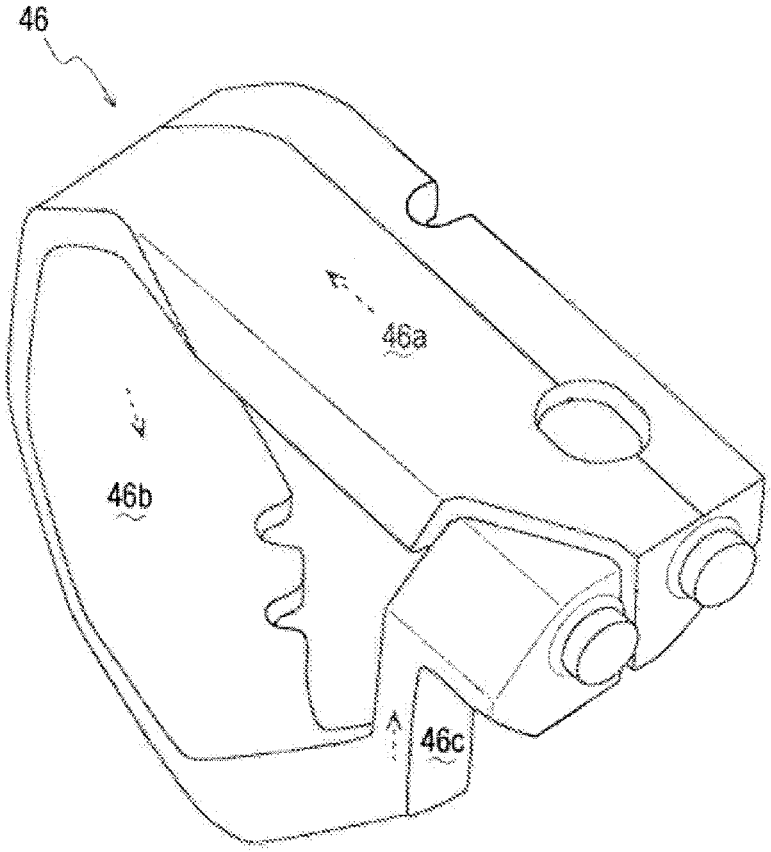
FIG. 6 It is a perspective front view of a circulation passage in the turbine cover.
Figure 7:
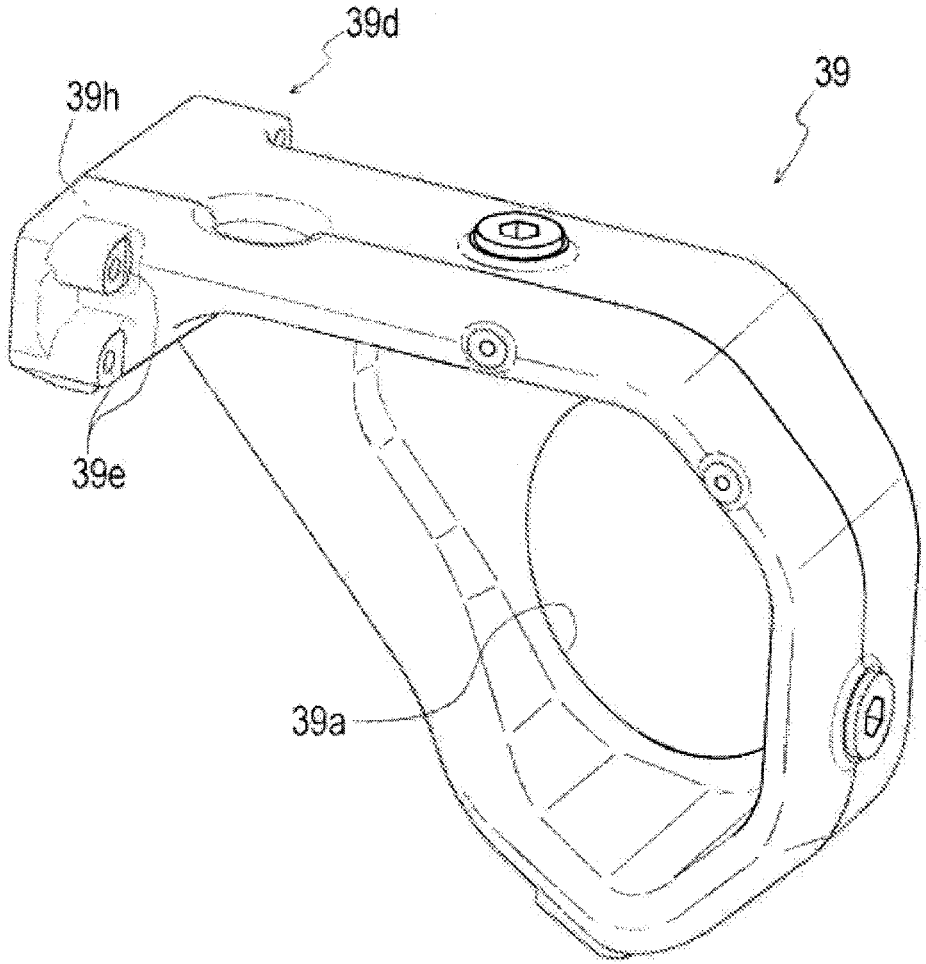
FIG. 7 It is a perspective rear view of the turbine cover.

A left and right pair of pure water inlet 39*f* and pure water outlet 39*g* is opened in the front surface of the attachment part 39*d*, and the pure water inlet 39*f* and the pure water outlet 39*g* are communicated with inside of a circulation passage 46 which is formed integrally in the turbine cover 39 and shown in FIG. 6. The circulation passage 46 includes a horizontal waterway 46*a* whose front end is communicated with the pure water inlet 39*f*, a downward waterway 46*b* connected to the rear end of the horizontal waterway 46*a*, and an upward waterway 46*c* connected to the front end of the downward waterway 46*b*. The front end of the upward waterway 46*c* is communicated with the pure water outlet 39*g*.

Since the exhaust gas from the exhaust manifold 13 flows along the rotational outer peripheral surface of the turbine wheel 35, the outer peripheral surface 40*e* which is positioned near the rotational outer peripheral surface is heated especially in the turbine housing 40. Along the outer peripheral surface 40*e*, the circulation passage 46 is provided in the turbine cover 39. Accordingly, the part neat the circulation passage 46 with high cooling efficiency is arranged closely to the part of the turbine housing 40 with especially high temperature, whereby the turbine housing 40 can be cooled efficiently.

Furthermore, the attachment part 39*d* of the turbine cover 39 in which the pure water inlet 39*f* and the pure water outlet 39*g* are opened at the front end thereof and the front flange 41*b* of the connection pipe 41 in which the exhaust inlet 41*c* to the turbine housing 40 is opened at the front end thereof are arranged in parallel vertically along substantially the same vertical plane 48 passing through a front side surface 39*h* of the turbine cover 39. Accordingly, the pure water inlet 39*f*, the pure water outlet 39*g* and the exhaust inlet 41*c* are arranged intensively near the rear end of the exhaust manifold 13 and the cover 15 thereof which are the attachment position of the exhaust turbine 19.

In this construction, fresh water for cooling the engine 1 flows from the fresh water cooler 28 through a pipe (not shown) provided in the cover 15 and the pure water inlet 39*f* into the circulation passage 46 in the turbine cover 39, and cools the turbine cover 39 while passing through the horizontal waterway 46*a*, the downward waterway 46*b* and the upward waterway 46*c* in this order. Subsequently, the fresh water discharged from the pure water outlet 39*g* is supplied to the cooling jacket of the engine 1 so as to water-cool the engine 1. The discharged pure water may alternatively be returned to the circulation system of pure water without being supplied to the cooling jacket of the engine 1.

The turbine cover 39 water-cooled as mentioned above has not only normal protection function for protecting the turbine housing 40 from pollution, corrosion and the like but also function as an outer low temperature part which absorb positively heat transmitted from the turbine housing 40 with high temperature by heat conduction and convection and simultaneously blocks radiation from the turbine housing 40. The turbine cover 39 surrounds the air layer 45 which functions as an inner heat insulating part with high heat insulating performance, whereby a cooling structure 47 according to the present invention is constructed.

Accordingly, in the case that the supercharger 2 is driven for long time, the outer surface of the turbine cover 39 corresponding to the outer surface of the cooling structure 47 is kept at low temperature by enough cooling action of pure water, whereby radiant heat is hardly discharged from the turbine cover 39.

In the cooling construction of the supercharger 2 having the turbine wheel 35 rotated by exhaust gas from the engine 1 and in which the cooling structure 47 including the inner heat insulating part constructed by the air layer 45 and the outer low temperature part surrounding the inner heat insulating part are provided around the turbine housing 40 in which the turbine wheel 35 is housed, the outer low temperature part is constructed by forming the circulation passage 46 of fresh water which is coolant integrally in the inside of the turbine cover 39 which is a cover member covering and protecting the turbine housing 40. Accordingly, the outer low temperature part of the cooling structure 47 can be provided by employing the turbine cover 39, whereby the part number of the cooling structure 47 can be reduced so as to reduce part cost and improve assemble ability and maintainability. Furthermore, it is not necessary to provide any cooling piping or the like on the outer surface of the turbine cover 39, whereby the establishment space required for the outer low temperature part can be reduced and the cooling structure 47 can be made compact. In this cooling structure 47, the turbine housing 40 can be made not touch directly the turbine cover 39 which is the outer low temperature part, whereby heat of exhaust gas in the turbine chamber 40*f* of the turbine housing 40 is prevented from being absorbed excessively so as to prevent the reduction of turbine efficiency. Moreover, when fresh water with low temperature is employed in the turbine cover 39, the rise of temperature of the fresh water is reduced suitably by the air layer 45, whereby the reduction of cooling efficiency of the engine 1 and the like in which the fresh water is employed can be prevented. In addition, the heat transmitted from the turbine housing 40 by heat conduction and convection following the drive of the supercharger 2 for long time is absorbed effectively by the turbine cover 39, and radiation from the turbine housing 40 is blocked certainly by the turbine cover 39. Accordingly, the heat is discharged and the temperature of the outer surface of the turbine cover 39, that is, the outer surface of the cooling structure 47 does not become so high, whereby radiation heat to the circumference of the supercharger 2 can be reduced certainly.

Furthermore, the fresh water which is coolant is cooling water for cooling the engine 1. Accordingly, a conventional water cooling system for cooking an engine can be employed without providing separately the fresh water and any pump and tank for supplying the fresh water to the circulation passage 46, whereby the parts required for cooling the supercharger 2 can be reduced so as to further reduce the cost of parts, improve the maintainability and make the engine 1 compact.

In addition, the circulation passage 46 is provided along the rotational outer peripheral surface of the turbine wheel 35. Accordingly, the circulation passage 46 of the fresh water which is coolant can be disposed along the part of the turbine housing 40 with especially high temperature, whereby the cooling efficiency of the turbine cover 39 which is the outer low temperature part can be improved.

The pure water inlet 39*f* and the pure water outlet 39*g* which are a coolant port feeding and discharging the fresh water which is the coolant to the circulation passage 46 and the exhaust inlet 41*c* introducing exhaust gas from the engine 1 to the turbine housing 40 are arranged in parallel on the same side of the turbine cover 39 which is a cover member along the front side surface 39*h* of the turbine cover 39. Accordingly, the pure water inlet 39*f*, the pure water outlet 39*g* and the exhaust inlet 41*c* are arranged intensively in the vicinity of the rear end of the exhaust manifold 13 and the cover 15 thereof which are the attachment position of the exhaust turbine 19. Therefore, connection space required for feed/discharge of pure water and introduction of exhaust gas can be reduced, whereby the exhaust turbine 19, in its turn the supercharger 2 can be made compact.

INDUSTRIAL APPLICABILITY

The present invention can be employed generally for a supercharger having a turbine wheel rotated by exhaust gas from an engine.

The invention claimed is:

1. A cooling structure of a supercharger having a turbine wheel rotated by exhaust gas from an engine, the cooling structure comprising:

an inner heat insulating part including an air layer, wherein the inner heat insulating part surrounds a turbine housing that houses the turbine wheel; and an outer low temperature part surrounding the inner heat insulating part, wherein the outer low temperature part comprises a cover member and a coolant circulation passage formed within the cover member, wherein the cover member surrounds the turbine housing so as to define the outer low temperature part as surrounding the inner heat insulating part, and wherein the coolant circulation passage includes a coolant inlet adapted to feed coolant to the coolant circulation passage and includes a coolant outlet adapted to discharge coolant from the coolant circulation passage so that the coolant inlet and the coolant outlet are disposed adjacent to each other on an end surface of the cover member.

2. The cooling structure of the supercharger according to claim 1, further comprising:

an exhaust inlet adapted to introduce exhaust gas from the engine to the turbine housing, wherein the exhaust inlet is arranged on the same plane with the surface of the cover member having the coolant inlet and outlet so as to be adjacent to the coolant inlet and outlet.

3. The cooling structure of the supercharger according to claim 1, wherein the coolant circulation passage is provided along a rotational outer peripheral surface of the turbine wheel.

4. The cooling structure of the supercharger according to claim 1, wherein coolant in the coolant circulation passage is cooling water for cooling the engine.

5. The cooling structure of the supercharger according to claim 1, wherein the coolant circulation passage includes:

a first section;

a second section; and a third section, wherein the first section includes a first end proximate the coolant inlet and a second end proximate the second section, the second section includes a first end proximate the first section and a second end proximate the third section, and the third section includes a first end proximate the second section and a second end proximate the coolant outlet.

6. The cooling structure of the supercharger according to claim 1, wherein the cover member of the outer low temperature part contacts the inner heat insulating part.

7. The cooling structure of the supercharger according to claim 1, wherein the coolant circulation passage formed within the cover member is configured so that coolant in the coolant circulation passage does not contact the inner heat insulating part.

* * * * *

UNITED STATES PATENT AND TRADEMARK OFFICE

CERTIFICATE OF CORRECTION

PATENT NO. : 8,826,661 B2
APPLICATION NO. : 13/061444
DATED : September 9, 2014
INVENTOR(S) : Terumitsu Takahata It is certified that error appears in the above-identified patent and that said Letters Patent is hereby corrected as shown below:

Title Page, Item (56) References Cited under the "OTHER PUBLICATIONS" heading on the front page of the patent, "EP 09809639.3" should read --EP 09809639.9--.

Signed and Sealed this
Second Day of June, 2015

Michelle K. Lee

Michelle K. Lee
*Director of the United States Patent and Trademark Office*